US005904003A

United States Patent [19]

Stephen

[11] Patent Number: 5,904,003

[45] Date of Patent: May 18, 1999

[54] RETRACTABLE STADIUM COVER

[76] Inventor: John W. Stephen, 9552 Menzies St., Chilliwack, BC, Canada, V2P 5Y9

[21] Appl. No.: 09/058,117

[22] Filed: Apr. 9, 1998

[51] Int. Cl.[6] ..... E04B 1/342

[52] U.S. Cl. ..... 52/6; 52/2.18; 52/3; 52/64; 52/66

[58] Field of Search ..... 52/6, 64, 66, 67, 52/83, 2.18, 273, 3

[56] References Cited

U.S. PATENT DOCUMENTS

| | | | |
|---|---|---|---|
| 2,996,844 | 8/1961 | Paulson | 50/51 |
| 3,169,542 | 2/1965 | Neumark | 135/1 |
| 3,370,380 | 2/1968 | Petros | 49/40 |
| 3,510,996 | 5/1970 | Popil | 52/6 |
| 3,947,066 | 3/1976 | Nisley et al. | 52/66 |
| 3,960,403 | 6/1976 | Carella et al. | 52/66 |
| 4,013,018 | 3/1977 | Hansen et al. | 105/468 |
| 4,038,788 | 8/1977 | Claessens | 52/66 |
| 4,167,086 | 9/1979 | Oase | 52/2 |
| 4,257,199 | 3/1981 | Kuboyama | 52/6 |
| 4,306,390 | 12/1981 | Brown | 52/64 |
| 4,716,691 | 1/1988 | Allen et al. | 52/64 |
| 4,727,688 | 3/1988 | Kida et al. | 52/6 |
| 4,920,707 | 5/1990 | Moskaliuk et al. | 52/6 |
| 5,103,600 | 4/1992 | Geiger et al. | 52/6 |
| 5,257,481 | 11/1993 | Reppas et al. | 52/66 |

*Primary Examiner*—Carl D. Friedman
*Assistant Examiner*—Phi Dieu Tran A

[57] ABSTRACT

The stadium with retractable cover includes a peripheral wall defining an open top and a top peripheral edge. At least one floatation device is included which is adapted to rise in air. Next provided is at least one canopy mounted to the floatation device. At least one retraction assembly is adapted for selectively transferring the canopy between a closed orientation for closing the open top of the peripheral wall and an open orientation for exposing the open top of the peripheral wall.

11 Claims, 4 Drawing Sheets

FIG. 7
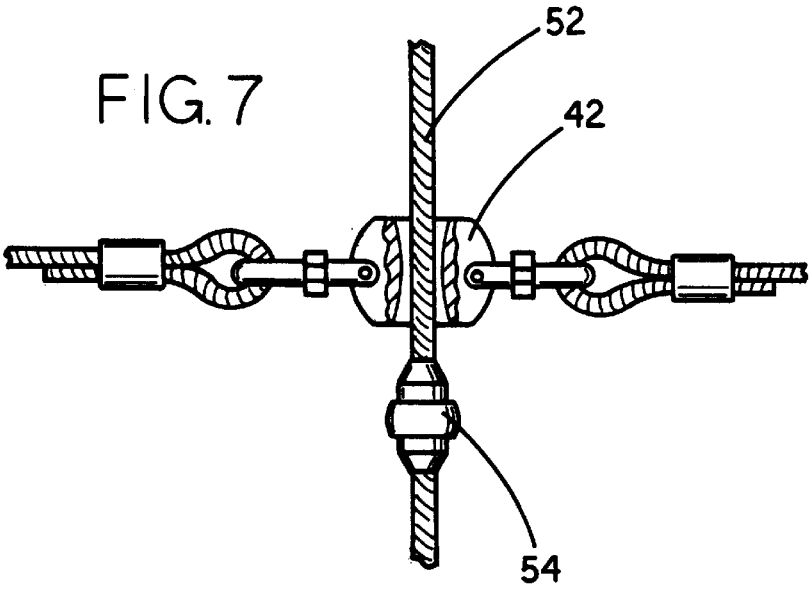
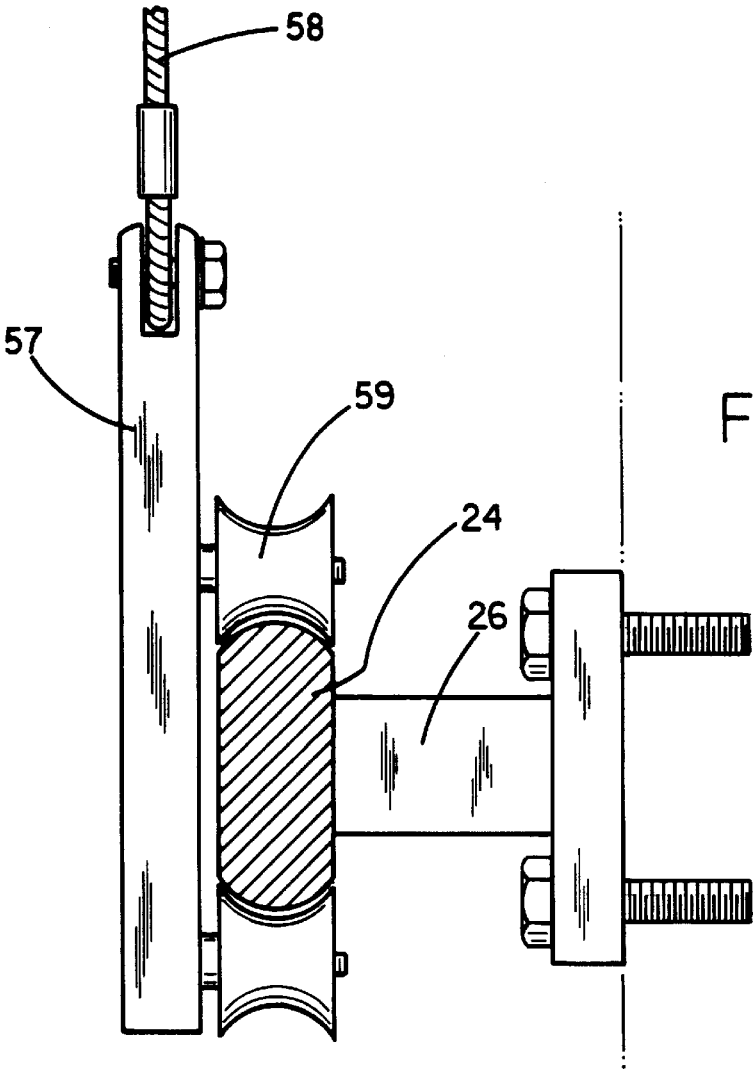
FIG. 8

RETRACTABLE STADIUM COVER

BACKGROUND OF THE INVENTION

1. Field of the Invention

The present invention relates to stadiums with hard-shell retractable covers and more particularly pertains to a new retractable stadium cover for selectively covering an open top of a stadium with a float supported canopy.

2. Description of the Prior Art

The use of with hard-shell retractable covers is known in the prior art. More specifically, with hard-shell retractable covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art with hard-shell retractable covers include U.S. Pat. No. 5,257,481; U.S. Pat. No. 5,167,097; U.S. Pat. No. 4,995,203; U.S. Pat. No. 4,831,792; U.S. Pat. No. 4,682,449; and U.S. Pat. No. 4,751,800.

In these respects, the retractable stadium cover according to the present invention substantially departs from the conventional concepts and designs of the prior art, and in so doing provides an apparatus primarily developed for the purpose of selectively covering an open top of a stadium with a float supported canopy.

SUMMARY OF THE INVENTION

In view of the foregoing disadvantages inherent in the known types of with hard-shell retractable covers now present in the prior art, the present invention provides a new retractable stadium cover construction wherein the same can be utilized for selectively covering an open top of a stadium with a float supported canopy.

The general purpose of the present invention, which will be described subsequently in greater detail, is to provide a new retractable stadium cover apparatus and method which has many of the advantages of the with hard-shell retractable covers mentioned heretofore and many novel features that result in a new retractable stadium cover which is not anticipated, rendered obvious, suggested, or even implied by any of the prior art with hard-shell retractable covers, either alone or in any combination thereof.

To attain this, the present invention generally comprises a peripheral wall formed of a vertically oriented cylinder with an open top and a top peripheral edge. As shown in FIG. 2 & 3, the top peripheral edge has an annular cavity mounted thereon which extends upwardly and radially inwardly therefrom. The annular cavity includes a lower extent defined by a portion of a sphere having a first diameter and an upper extent defined by a portion of a sphere having a second diameter greater than the first diameter. As shown in FIG. 4, a first pair of arcuate rails are formed along diametrically opposed sections of the top peripheral edge of the wall at a first elevation. Associated therewith is a second pair of arcuate rails formed along diametrically opposed sections of the top peripheral edge of the wall at a second elevation. FIG. 1 shows that a portion of the first pair of rails is situated directly above and radially inward from a portion of the second pair of rails. Next provided is a pair of primary floatation tube assemblies situated in parallel. Each primary floatation tube assembly includes a plurality of elongated helium filled tubes each with a tubular intermediate extent and a pair of conical end extents. The tubes of the primary floatation tube assemblies are coupled in linear alignment by way of cables. Each floatation tube assembly has a pair of ends coupled to a counter weight assembly. A pair of secondary floatation tube assemblies are situated in parallel and each include a plurality of elongated helium filled tubes. Similar to the tubes of the primary floatation tube assemblies, the present tubes are each equipped with a tubular intermediate extent and a pair of conical end extents. The tubes of the secondary floatation tube assemblies are coupled in linear alignment by way of cables. Each floatation tube assembly has a pair of ends coupled to the top peripheral edge of the wall. As shown in FIG. 7, a cable between the tubes of each secondary floatation tube assembly have a sleeve formed thereon. Also included is a pair of retraction assemblies. Each of the assemblies has a plurality of spaced winches situated within the annular cavity on opposite sides of the peripheral top edge of the housing. The winches of each retraction assembly are connected to an associated wire which is situated through the corresponding sleeve of an associated one of the secondary floatation tube assemblies. Each wire further terminates with a coupling to the corresponding primary floatation tube assembly. For reasons that will become apparent hereinafter, each cable has a stopper coupled adjacent an end thereof. FIGS. 1 & 3 show a pair of canopies each defined by a portion of a sphere. Accordingly, each canopy has an arcuate edge which has a central portion thereof mounted within the annular cavity and a pair of end portions slidably mounted to an associated one of the rails. A linear edge is mounted along an associated one of the primary floatation assemblies. Finally, an intermediate extent of each canopy is mounted atop the corresponding secondary floatation assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also,.it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new retractable stadium cover apparatus and method which has many of the advantages of the with hard-shell retractable covers mentioned heretofore and many novel features that result in a new retractable stadium cover which is not anticipated, rendered obvious, suggested, or even implied by any of the prior art with hard-shell retractable covers, either alone or in any combination thereof.

It is another object of the present invention to provide a new retractable stadium cover which may be easily and efficiently manufactured and marketed.

It is a further object of the present invention to provide a new retractable stadium cover which is of a durable and reliable construction.

An even further object of the present invention is to provide a new retractable stadium cover which is susceptible of a low cost of manufacture with regard to both materials and labor, and which accordingly is then susceptible of low prices of sale to the consuming public, thereby making such retractable stadium cover economically available to the buying public.

Still yet another object of the present invention is to provide a new retractable stadium cover which provides in the apparatuses and methods of the prior art some of the advantages thereof, while simultaneously overcoming some of the disadvantages normally associated therewith.

Still another object of the present invention is to provide a new retractable stadium cover for selectively covering an open top of a stadium with a float supported canopy.

Yet another object of the present invention is to provide a new retractable stadium cover which includes a peripheral wall defining an open top and a top peripheral edge. At least one floatation device is included which is adapted to rise in air. Next provided is at least one canopy mounted to the floatation device. At least one retraction assembly is adapted for selectively transferring the canopy between a closed orientation for closing the open top of the peripheral wall and an open orientation for exposing the open top of the peripheral wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is cross-sectional view of one of the sleeves of the secondary floatation tube assemblies FIG. 8 is a cross-sectional view of one of the rails of the present invention.

DESCRIPTION OF THE PREFERRED EMBODIMENT

Figure 1:
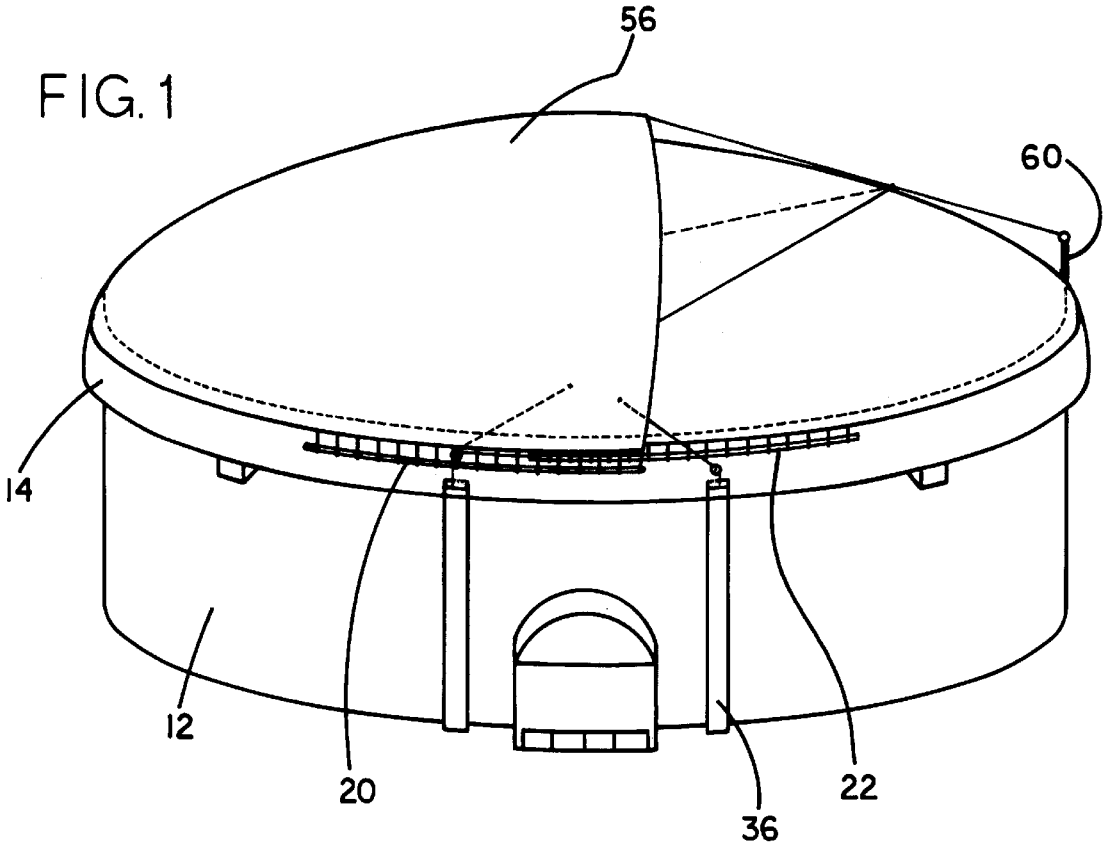
FIG. 1 is a perspective view of a new retractable stadium cover according to the present invention.

With reference now to the drawings, and in particular to FIGS. 1 through 8 thereof, a new retractable stadium cover embodying the principles and concepts of the present invention and generally designated by the reference numeral 10 will be described.

Figure 2:
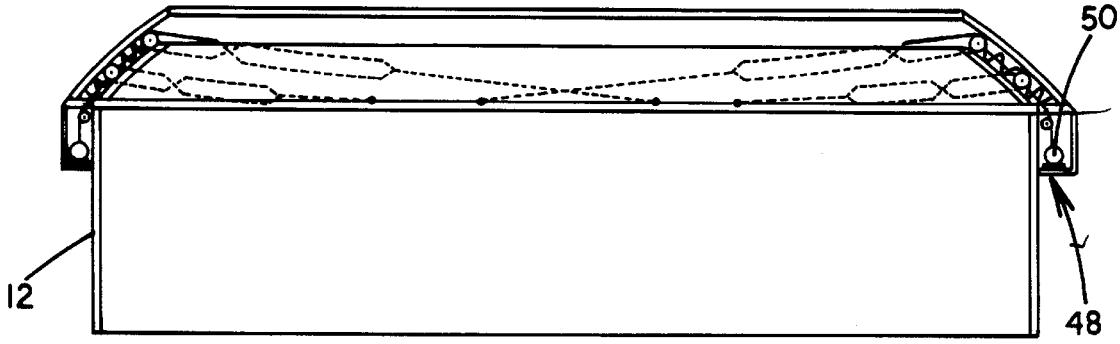
FIG. 2 is a side cross-sectional view of the present invention with the canopies retracted.
Figure 3:
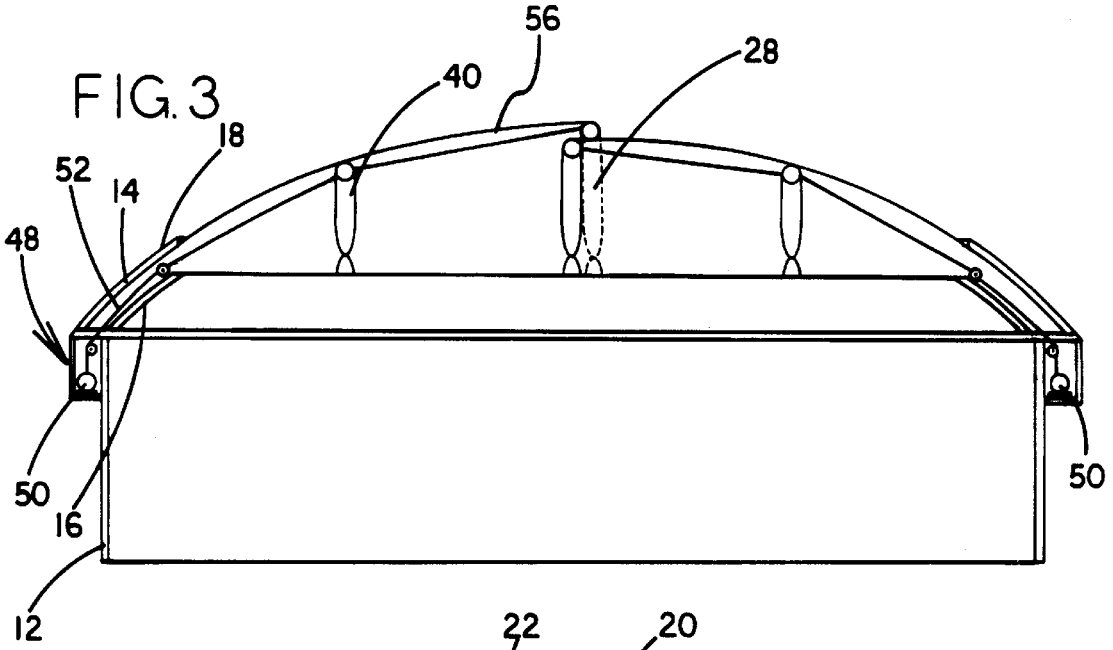
FIG. 3 is a cross-sectional view of the present invention with the canopies erect.

The present invention, as designated as numeral 10, includes a peripheral wall 12 formed of a vertically oriented cylinder with an open circular top and a top peripheral edge. As shown in FIGS. 2 & 3, the top peripheral edge has an annular cavity 14 mounted thereon which extends upwardly and radially inwardly therefrom. The annular cavity includes a lower extent 16 defined by a portion of a sphere having a first diameter and an upper extent 18 defined by a portion of a sphere having a second diameter greater than the first diameter.

Figure 4:
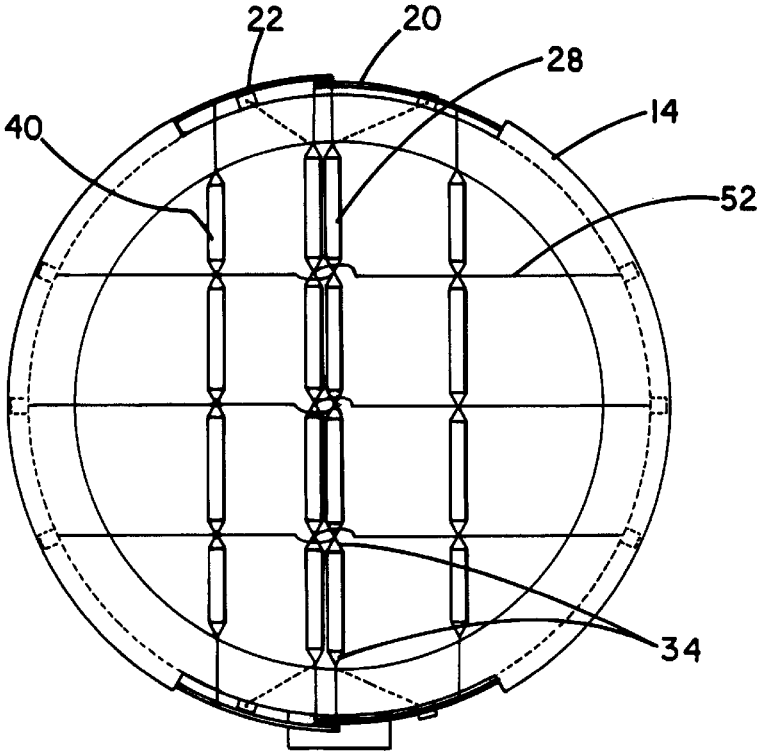
FIG. 4 is a top view of the present invention, revealing the floatation assemblies which, as shown in FIG. 3, are positioned on the underside of the canopies.
Figure 5:
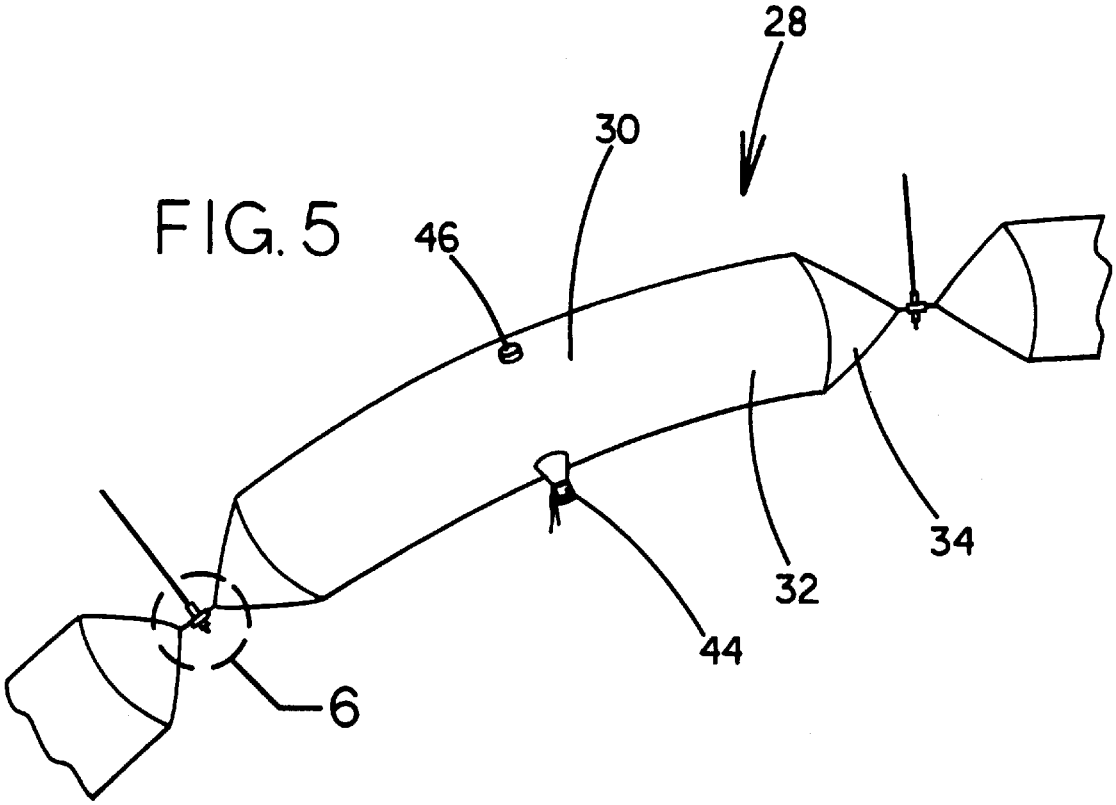
FIG. 5 is a perspective view of one of the tubes of the floatation tube assemblies of the present invention.
Figure 6:
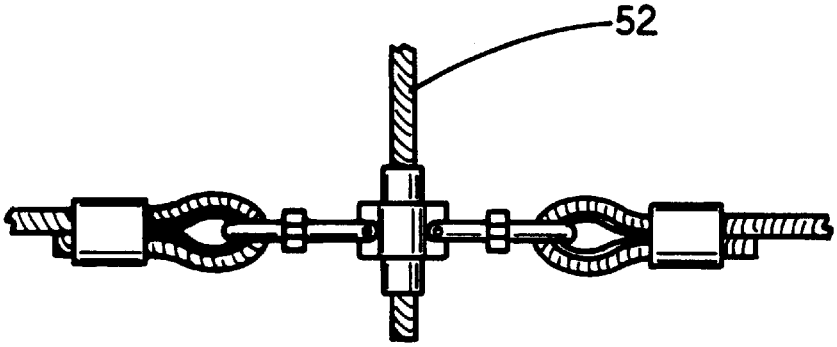
FIG. 6 is an illustration of the coupling between the tubes of the present invention.

As shown in FIG. 4, a first pair of arcuate rails 20 are formed along diametrically opposed sections of the top peripheral edge of the wall at a first elevation. Associated therewith is a second pair of arcuate rails 22 formed along diametrically opposed sections of the top peripheral edge of the wall at a second elevation. FIG. 1 shows that a portion of the first pair of rails is situated directly above and radially inward from a portion of the second pair of rails. As shown in FIG. 8, each of the rails includes a rail strip 24 mounted to the peripheral wall by a bracket 26.

Next provided is a pair of primary floatation tube assemblies 28 situated in parallel. Each primary floatation tube assembly includes a plurality of elongated helium filled tubes 30 each with a tubular intermediate extent 32 and a pair of conical end extents 34. The tubes of the primary floatation tube assemblies are coupled in linear alignment by way of cables. Each floatation tube assembly has a pair of ends coupled to a counter weight assembly 36. It should be noted that the counter weight assemblies include a pair of weights slidably mounted along a vertical axis on each side of the peripheral wall.

A pair of secondary floatation tube assemblies 40 are situated in parallel and each include a plurality of elongated helium filled tubes. Similar to the tubes of the primary floatation tube assemblies, the present tubes are each equipped with a tubular intermediate extent and a pair of conical end extents. The tubes of the secondary floatation tube assemblies are coupled in linear alignment by way of cables. As shown in FIG. 7, a cable between the tubes of each secondary floatation tube assembly have a sleeve 42 formed thereon. Ends of the cables of the secondary floatation tube assembly are preferably attached to the top peripheral edge of the wall.

The tubes of each floatation tube assembly is preferably equipped with a valve 44 for supplying additional helium when needed. Further, a gauge 46 is also situated on each tube for storing and optionally transmitting the current pressure of helium therein for monitoring and maintenance purposes.

Also included is a pair of retraction assemblies 48 positioned on opposite sides of the peripheral wall. Each of the assemblies has a plurality of spaced winches 50 situated within the annular cavity on opposite sides of the peripheral top edge of the housing. The winches of each retraction assembly are connected to an associated wire 52, or cable, which is situated through the corresponding sleeve of an associated one of the secondary floatation tube assemblies. Each wire further terminates with a coupling to the corresponding primary floatation tube assembly. For reasons that will become apparent hereinafter, each cable has a stopper 54 coupled adjacent an end thereof, as shown in FIG. 7.

FIGS. 1 & 3 show a pair of canopies 56 each defined by a portion of a sphere. Accordingly, each canopy has an arcuate edge which has a central portion thereof mounted within the annular cavity. The arcuate edge further has a pair of end portion slidable coupled to an associated one of the rails. A linear edge is mounted along an associated one of the primary floatation assemblies. Finally, an intermediate extent of each canopy is mounted atop the corresponding secondary floatation assembly. Such mounting is preferably accomplished by way of an adhesive, stitching or the like.

Each end portion of the canopies has a plurality of rollers 57 coupled thereto via wires 58 wherein each roller is slidably mounted on the corresponding rail. Preferably, a first end portion of each canopy is coupled to one of the first pair of rails and a second end portion of each canopy is slidably coupled to one of the second pair of rails. Shown in FIG. 8 is one of the aforementioned rollers. As shown in such Figure, the rollers are equipped with wheels 59 that abut an upper and lower surface of the associated rail.

In use, each canopy has an erection mode wherein.the winches release the wires of the retraction assemblies and the primary and secondary floatation tube assemblies exit the annular cavity. During such exiting, the end portions of the canopies slide from a first end to a second end of the associated rails. When ends of the primary floatation tube assemblies reach the second ends of the corresponding rails the primary floatation assemblies extend past a diameter of the peripheral wall and overlap thereby fully enclosing the open top defined by the peripheral wall.

Further, each canopy has a retraction mode wherein the winches retract the wires of the retraction assemblies and the primary and secondary floatation assemblies enter the annular cavity for storage therein. When stored, the canopies are gathered between the corresponding floatation tube assemblies. Note FIG. 2. While being retracted, the end portions of the canopies slide from the second end to the first end of the associated rails. During such, the wires slide through the sleeves of the secondary floatation tube assemblies until the primary floatation tube assembly is adjacent thereto. At such point, the stopper engages the sleeve for allowing the retraction of both floatation tube assemblies.

As an option, a stanchion 60 may be mounted to the top peripheral edge of the peripheral wall and be equipped with a single pulley directing a three branch cable for connecting the linear edge of the upper canopy to a winch in the annular cavity to provide lateral stability in its erected position. Note FIG. 1. A stanchion is not required for the lower canopy and the pulley can be mounted directly on the opposite lower edge of the annular cavity. In this location, its three branch cable will not interfere with the raising and lowering of the upper canopy. An unillustrated flap may also depend from a point adjacent the linear edge of the upper canopy for engaging a lower one of the canopies thus affording a seal.

A variation may be employed for controlling the dissipation of the braking energy afforded by the counterweights when the canopies are near the fully retracted or erected orientation. Such variation is to adopt the passenger elevator technique of balanced loads. One method is to mount the counterweights on a curved track that is shaped so that the pull of gravity follows the same, or nearly the same, values that are in the hoist cables at any given position of the moving cover, whether it is going up or down. To take care of the large difference in travel between the primary floatation tube assemblies and their respective counterweights, the cable linkage to the counterweights can incorporate cable gearing, i.e., the number of cables supporting the counterweights may be doubled, or quadrupled, by looping the supporting cable through additional sheaves. This shortens their travel distance by the inverse ratio of the number of supporting cables. Any associated difficulties can thus be overcome. It becomes a matter of convenience and economics, use and cost of high-powered winches with dynamic or regenerative braking vs. low-powered hoists with extensive rail construction and counterweights.

Another variation for raising and lowering the cover that would be more suitable to rectangular and medium sized enclosures, such as skating rinks, tennis courts, outdoor food-markets and outdoor concert areas, etc., would be to adopt the pulley-clothesline technique. Two clotheslines would be required, one for each of two parallel sides. An electric drive-motor with speed and brake controls, would be mounted below each of the two pulleys at one end of the enclosure, and coupled to it's respective pulley shaft with pulleys and belt-cable. The floatation tube assemblies of the cover would be attached at each end to the top-side of the clothesline. All would be free to move longitudinally along the two cables on swiveled, roller attachments, except for one, the number one counting from the pair of pulleys at the other end of the enclosure. It would be permanently attached at each of it's ends to the cable pair. It therefore would move longitudinally with any cable movement. An operator can then drive it from one end of the enclosure to the other. The edge of the canopy section next to the motor-end enclosure, is permanently attached and sealed to it, thus providing the anchor that limits the travel of the floating tubes so that a reasonably tautness can be obtained in the canopy sections.

For small enclosures, such as camping tents, the lighter-than-air gas [Helium] could be dispensed with and the tubes inflated with air to a high enough pressure to give them sufficient rigidity to support the canopy when they are raised by hand to their up-right positions. The simplest and easiest to handle configuration would be two arched halves, but with only two sections per tube. The two halves would sit on the ground and be held in their up-right positions by ropes attached to the central point of each primary tube and secured both ways to stakes in the ground or to nearby trees. The two halves permit easy escape through the split-top if air pressure fails in one or more tube sections. To improve the inside head-space, the tubes could be mounted on the outside of the canopy since snow build-up would not be a problem on such a small enclosure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stadium with retractable cover comprising, in combination:

a peripheral wall formed of a vertically oriented cylinder with an open top and a top peripheral edge, the top peripheral edge having an annular cavity mounted thereon and extending upwardly and radially inwardly therefrom, the annular cavity including a lower extent defined by a portion of a sphere having a first diameter and an upper extent defined by a portion of a sphere having a second diameter greater than the first diameter;

a first pair of arcuate rails formed along diametrically opposed sections of the top peripheral edge of the wall at a first elevation and a second pair of arcuate rails formed along diametrically opposed sections of the top peripheral edge of the wall at a second elevation, wherein a portion of the first pair of rails is situated directly above and radially inward from a portion of the second pair of rails;

a pair of primary floatation tube assemblies situated in parallel and each including a plurality of elongated helium filled tubes each with a tubular intermediate extent and a pair of conical end extents, the tubes of the primary floatation tube assemblies coupled in linear alignment by way of cables with each floatation tube assembly having a pair of ends coupled to a counter weight assembly;

a pair of secondary floatation tube assemblies situated in parallel and each including a plurality of elongated helium filled tubes each with a tubular intermediate extent and a pair of conical end extents, the tubes of the secondary floatation tube assemblies coupled in linear alignment by way of cables with each floatation tube assembly having a pair of ends coupled to the top peripheral edge of the wall, a cable between the tubes of each secondary floatation tube assembly having a sleeve formed thereon;

a pair of retraction assemblies each including a plurality of spaced winches situated within the annular cavity on opposite sides of the peripheral top edge of the housing, the winches of each retraction assembly connected to an associated wire which is situated through the corresponding sleeve of an associated one of the secondary floatation tube assemblies and terminating with a coupling with the corresponding primary floatation tube assembly, each cable having a stopper coupled adjacent an end thereof;

a pair of canopies each defined by a portion of a sphere with an arcuate edge having a central portion thereof mounted within the annular cavity and end portions thereof slidably coupled to an associated one of the rails, a linear edge mounted along an associated one of the primary floatation assemblies and an intermediate extent mounted atop the corresponding secondary floatation assembly;

whereby each canopy has an erection mode wherein the winches release the wires of the retraction assemblies and the primary, and secondary floatation assemblies exit the annular cavity and the end portion of the canopy slides between a first end and a second end of the associated rails whereat the primary floatation assemblies extend past a diameter of the peripheral wall thereby fully enclosing the open top defined by the peripheral wall;

whereby each canopy further has a retraction mode wherein the winches retract the wires of the retraction assemblies and the primary and secondary floatation assemblies enter the annular cavity for storage therein with the corresponding canopy gathered therebetween and the end portion of each canopy slides between the second end and the first end of the associated rails with the wires sliding through the sleeves of the secondary floatation tube assemblies until the primary floatation tube assembly is adjacent whereat the stopper engages the sleeves for allowing the retraction of both floatation tube assemblies.

2. A stadium with retractable cover comprising:

a peripheral wall defining an open top and a top peripheral edge;

a plurality of floatation devices adapted to rise in air;

at least one retraction assembly for selectively transferring the floatation devices between a raised and lowered orientation; and a flexible canopy mounted to the floatation devices such that the floatation devices are spaced with respect to each other along the canopy and adapted to selectively cover the open top of the peripheral wall with the raising and lowering of the floatation devices wherein the canopy collapses upon the lowering of the floatation devices such that the flotation devices substantially abut.

3. A stadium with retractable cover as set forth in claim 2 wherein the peripheral wall is equipped with at least one cavity for storing the canopy.

4. A stadium with retractable cover as set forth in claim 2 wherein each floatation device is filled with helium.

5. A stadium with retractable cover as set forth in claim 4 wherein the floatation devices each include a plurality of discreet elongated tubes coupled end to end.

6. A stadium with retractable cover as set forth in claim 2 wherein a portion of the canopy is slidably mounted to rails formed along the top peripheral edge of the wall.

7. A stadium with retractable cover as set forth in claim 2 wherein the at least one retraction assembly takes the form of at least one winch and cable.

8. A stadium with retractable cover as set forth in claim 2 wherein the peripheral wall is formed of a vertically oriented cylinder.

9. A stadium with retractable cover as set forth in claim 8 wherein the canopy takes the form of a pair of portions each defined by a section of a sphere.

10. A stadium with retractable cover as set forth in claim 2 wherein the at least one retraction assembly includes at least one cable slidably positioned within sleeves coupled to the floatation devices and having a plurality of stoppers mounted thereon for engaging the sleeves.

11. A stadium with retractable cover as set forth in claim 2 wherein the canopy includes a pair of portions each including a plurality of end most floatation devices of which overlap.

* * * * *